United States Patent [19]

Berard

[11] Patent Number: 4,798,386

[45] Date of Patent: Jan. 17, 1989

[54] GOLF BALL WITH FLUORESCENT COVER

[75] Inventor: Raymond A. Berard, Portsmouth, R.I.

[73] Assignee: Acushnet Company, New Bedford, Mass.

[21] Appl. No.: 154,533

[22] Filed: Feb. 11, 1988

Related U.S. Application Data

[63] Continuation of Ser. No. 946,105, Dec. 22, 1986, abandoned, which is a continuation of Ser. No. 786,131, Oct. 2, 1985, abandoned, which is a continuation of Ser. No. 383,379, May 28, 1982, abandoned.

[51] Int. Cl.[4] ..... A63B 37/12

[52] U.S. Cl. ..... 273/235 R; 273/DIG. 22; 273/DIG. 24; 273/DIG. 14; 273/213; 264/239; 40/327

[58] Field of Search ..... 273/235 R, 235 A, 235 B, 273/218, DIG. 24, DIG. 22, 219, 233, 234, 62, 14; 40/327

[56] References Cited

U.S. PATENT DOCUMENTS

| | | | |
|---|---|---|---|
| 2,050,402 | 8/1936 | Walsh | 273/DIG. 24 |
| 2,606,030 | 8/1952 | Tjomsland | 273/DIG. 24 |
| 3,649,029 | 3/1972 | Worrell | 273/DIG. 24 |
| 3,918,719 | 11/1975 | Welch | 273/DIG. 24 |
| 4,141,559 | 2/1979 | Melvin et al. | 273/235 R |
| 4,170,352 | 10/1979 | Vcala | 273/61 R |
| 4,679,795 | 7/1988 | Melvin et al. | 273/235 R |

FOREIGN PATENT DOCUMENTS

| | | | |
|---|---|---|---|
| 0144649 | 10/1980 | Fed. Rep. of Germany | 273/DIG. 24 |
| 782249 | 9/1957 | United Kingdom | 273/588 A |
| 815634 | 7/1959 | United Kingdom | 273/235 R |
| 924877 | 5/1963 | United Kingdom | 273/213 |
| 1258138 | 12/1971 | United Kingdom | 273/235 R |
| 1386382 | 3/1975 | United Kingdom | 273/235 R |
| 1538860 | 1/1979 | United Kingdom | 273/61 R |

OTHER PUBLICATIONS

"Gold Digest", Oct. 1981, p. 19, Relied On Copy Available in 273-213.

*Primary Examiner*—George J. Marlo
*Attorney, Agent, or Firm*—Lucas & Just

[57] ABSTRACT

An improved colored golf ball is disclosed. The golf ball is made with a fluorescent coloring. In order to improve durability and give very pleasing aesthetics, the fluorescent coloring is blended into the cover stock. The name and/or number preferably are stamped directly onto the core for surprisingly superior durability. The cover stock can suitably be a clear ionomer resin and for highest gloss a clear final coating can be applied. If the name or trademark is stamped directly onto the core, it is visible through the clear cover. A UV stabilizer may be included. If a dye is used, it is preferred that it be 0.01-0.4% by weight of the cover and if a pigment is used the preferred range is 0.5-6% by weight of the cover.

5 Claims, 1 Drawing Sheet

GOLF BALL WITH FLUORESCENT COVER

Figure 1:
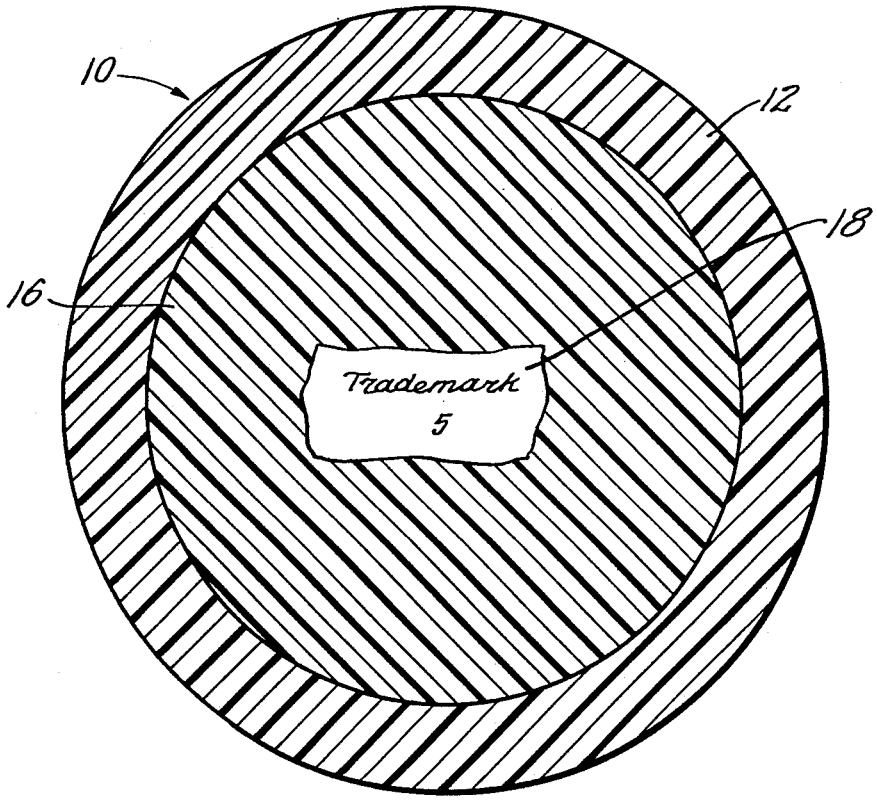

This is a continuation of application Ser. No. 946,105 filed Dec. 22, 1986, which was a continuation of Ser. No. 786,131 filed Oct. 2, 1985, which in turn was a continuation of Ser. No. 383,379 filed May 28, 1982, all of which are now abandoned.

The present invention relates to golf balls and, in particular, golf balls having a fluorescent appearance rather than the traditional white appearance.

For approximately the last 40–50 years golf balls have been made by bonding a cover about a core. The cover can either be compression molded from two half shells or it can be directly injection molded as a fluid about the core. Until about the mid 1960's most golf ball covers were made of a natural resin, notably balata. Since the mid 60's a synthetic resin sold under the trademark "Surlyn" by E. I. Dupont has increasingly assumed a greater position as a golf ball cover material and it has, today, the major share of the market. Covers made of such materials are described in prior U.S. patents.

Various attempts have been made over the years to make one piece solid golf balls. However, no one has succeeded in making a top grade one piece golf ball. Top grade golf balls today are made with a cover material as mentioned hereinbefore molded about a core, with the core being either a wound core or a solid core, both of which are very well known in the art.

No matter what the construction of the golf ball or the composition of the cover, it has been the practice in the art to apply a finish to the surface of the golf ball cover. This is an elaborate, expensive and highly developed technology. A typical painting operation with a Surlyn covered golf ball involves sand blasting the surface of the cover, washing, drying and then the successive steps of applying a primer, drying the primer at about 100° F., applying a first white coat, drying the first coat at about 100° F., applying a second white coat, drying the second coat at about 100° F., stamping a trademark and numbers, and then following with a clear finish coat and drying it at about 100° F. Despite these many steps, even the best of manufacturers have some wearing away of the paint surface, especially after extensive use of the ball. This is especially true with the Surlyn covered golf balls.

The problem is paraticularly acute when the cover is a different color from the paint system as is the case with both balata and Surlyn covers when they are painted white. Most manufacturers attempt to compensate for this color difference by including a whitening agent, usually titanium dioxide, in the cover composition. This imparts a white appearance to the cover. However, this is quite a dull white appearance and the difference between the surface color and the cover, even where the cover contains titanium oxide, is generally quite noticeable to the golfer as the paint wears away.

While they have generally fallen out of favor today, there was a time when red coated golf balls were manufactured and sold, particularly for play by "snow birds". One of the reasons that these were not generally accepted, even though they could be very well seen as compared to a white golf ball when played in snowy or heavy frost conditions, was that the paint would come off fairly quickly revealing the white cover. This caused the balls to be associated with poor quality, as a result of which sale of them was never very great. There have also been attempts from time to time to market pastel coated golf balls as "ladies balls". These have, however, never achieved great success and this is also believed to be a result of the appearance-durability problem.

At the present time there is a craze sweeping the golf ball world with respect to golf balls covered with fluorescent paint. These golf balls have been found by many to be substantially more visible than the traditional white golf balls. While some have predicted that this craze will go the way of aluminum shafts, graphite shafts, floating golf balls, steel centers and the like, others predict that fluorescent golf balls will become a permanent and large share of the golf ball market.

One of the circumstances that may prevent these fluorescent colored golf balls from becoming a permanent share of the market is the old problem of paint wear. As with the snow bird and ladies golf balls, the fluorescent covered golf balls are having a substantial problem with paint wear and the balls on the market today are showing quite poor appearance-durability. Not only do the paints wear away to show the cover color, but they also have a substantial tendency to chip off revealing large portions of the cover.

The applicant has now discovered that the appearance-durability problem of fluorescent covered golf balls can be overcome by incorporating the fluorescent material directly into the cover composition. This is not a simple replacement of the titanium dioxide for white golf balls with a fluorescent coloring agent for fluorescent golf balls. Quite the contrary, the applicant has found that fluorescent material incorporated in the cover of the golf ball can be used as the finished cover of the golf ball. The final surface of the golf ball may be clear coated as in the past; however, no opaque coating is applied as has been done with golf balls, including colored golf balls, since the 20's.

The present invention is especially advantageous where the golf ball cover material is clear, e.g. most Surlyn resins. While a wound golf ball can be used with a clear cover for "special effects" it is preferred that the core be a one-piece solid. It is also preferred that the core be essentially white in color. Where a white core is used with a clear cover, the stamping can be put directly on the core and can be seen through the cover. This is true even where a fluorescent material is used to color the golf ball cover material. This is of very great advantage since it ensures a long lasting and, indeed, relatively permanent retention of the trademark and identification number and any other markings put on the ball. This also overcomes one of the more difficult problems of high quality golf ball manufacture, poor stamping. It advantageously permits the use of a low quality foil for the stamping since the foil is not required to have durability characteristics.

While the golf ball with the fluorescent material therein is a very good looking golf ball, the gloss can be made even greater by the application of one or more clear, or essentially clear, top coats. The top coat should be of sufficient clarity so that the covered material can be seen therebeneath. If the top coat is opaque, the primary advantages of the present invention cannot be obtained.

The fluorescent materials useful in the present invention are commercially available fluorescent pigments and dyes. They are described in U.S. Pat. Nos. 2,809,954, 2,938,873, 2,851,424 or 3,412,036. A good commercial source for these products is Dayglo Color Corporation. As described in the cited patents, these fluorescent daylight materials are organic co-condensates. They are typically composed of melamine, an aldehyde such as formaldehyde, a heterocyclic compound and/or an aromatic sulfonamide. Typical of such materials is Solvent Yellow 44, compounds containing which are sold by DayGlo under the trademark Saturn Yellow and by Lawter under the trademark Lemon Yellow. The amount of fluorescent material to be used is largely a matter of choice depending on the brightness desired. However, it is preferred that the amount of fluorescent dye be from about 0.01% to about 0.40% by weight of the cover composition and the amount of fluorescent pigment be from about 0.5% to about 6% by weight of the cover composition.

Because of the relatively unstable nature of fluorescent pigments and dyes, and especially because of the outside use to which golf balls are put, it is preferred that a U.V. stabilizer be added to the cover composition. If either the fluorescent material or the cover material comes with sufficient U.V stabilizer, it is obviously not beneficial to add more. However, whether present in the cover materials or added thereto, it is preferred that a U.V. stabilizer be present in the amount of from about 0.1% to about 3.0% by weight of the cover, more preferably from about 0.5% to about 2.0%.

Where it is desired that the trademark and number be put on the surface of the golf ball cover rather than on the core, a fluorescent pigment can be used rather than a fluorescent dye. This will give a translucent fluorescent cover. However, as in the situation where the fluorescent dye is used, no opaque finish is applied to the surface of the golf ball; if any coating is used, it is an essentially clear coating.

It is also possible to obtain special effects by adding other coloring materials. For example, a white opacifying agent such as titanium dioxide or calcium carbonate can be used to make the cover essentially opaque. This can be used to hide the threads of a wound golf ball. Again, in this case, however, it is preferred that any coating be limited to a clear coating.

These and other advantages of the present invention may be understood from the following drawings and examples:

IN THE DRAWINGS

Figure 2:
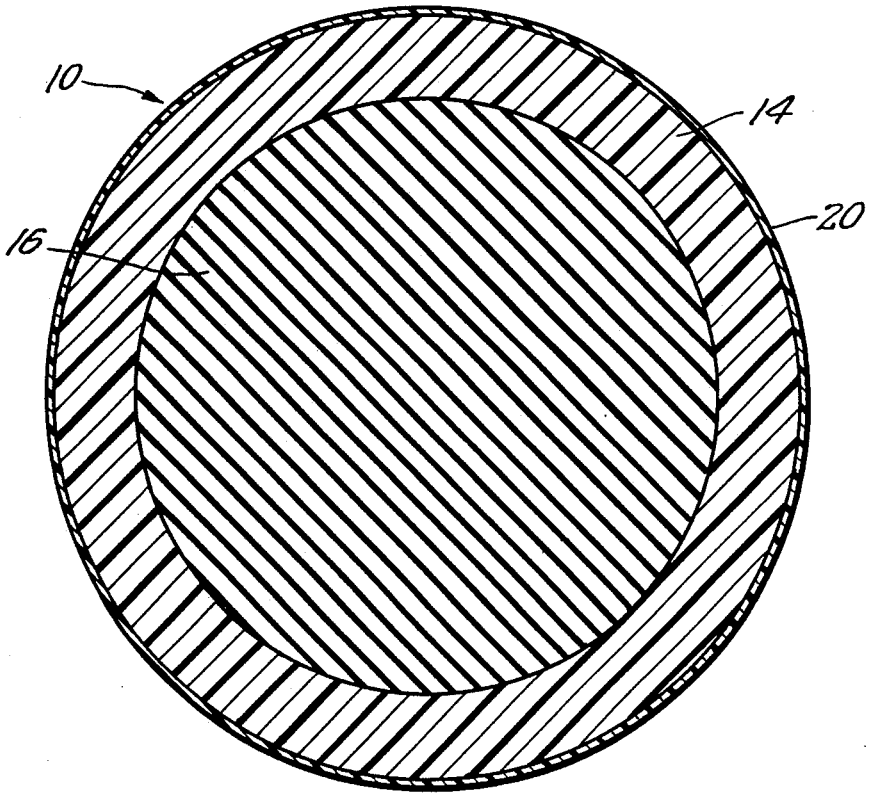

FIG. 1 shows a golf ball according to the present invention with a solid core having indicia thereon and a transparent cover; and FIG. 2 shows a golf ball according to the present invention having a fluorescent cover with a transparent coating applied to the surface thereof. Referring specifically to FIG. 1, there is shown a golf ball 10 having a transparent cover 12 over a solid core 16. The cover 12 may contain a fluorescent dye so long as the cover is still transparent. Affixed to the core 16 is indicia 18, suitably stamped, which is visible through the transparent cover 12.

Turning now to FIG. 2, there is shown a golf ball 10 having a cover 14 applied to a core 16. The core may be either solid or wound. The cover has a fluorescent dye or a fluorescent pigment incorporated therein and may also include an opacifying agent. On top of the cover 14 is affixed a transparent coating 20. There is no opaque coating between the cover 14 and the transparent coating 20.

The following are specific examples according to the present invention.

EXAMPLE 1

A solid core was used for the golf ball. The solid core was white in appearance and was the core from the commercially available PINNACLE golf ball. The cover composition was prepared by admixing 99.96% by weight Surlyn and 0.04% by weight Dayglo Fluorescent Dye Saturn Yellow. The cover composition was formed into golf ball half shells in the standard manner in an injection molding machine. At the same time, the golf ball core was stamped with a trademark and a number. Thereafter the golf ball half shells were compression molded about the core. The flash line from the compression molding was removed by buffing. It was noted that substantially less care was required in the buffing operation than that usually required with titanium dioxide pigmented golf ball covers. The buffed golf ball was then clear coated in the standard manner.

The resulting golf ball had a very pleasing fluorescent appearance with a high degree of gloss. The trademark was clearly visible through the cover. In extended hitting tests, the golf ball was found to have substantially better appearance-durability than commercially available fluorescent colored golf balls. At the end of 200 hits equivalent to 200 yard drives, the appearance was almost the same as the initial appearance and the trademark was still fully intact and clearly visible.

EXAMPLE 2

Example 1 is repeated with the same cover composition on a wound core. In this case, however, the trademark is applied to the surface of the golf ball cover before the clear coat is applied. A golf ball with the windings visible is obtained.

EXAMPLE 3

Example 1 is again repeated except that in this case a clear coat is not employed. A comparable golf ball but somewhat less gloss is obtained.

EXAMPLE 4

Example 1 is repeated except that in the place of the Dayglo Saturn Yellow, the Lemon Yellow from the Lawter Chemical Co. of Skokie, Ill. is used. Comparable results are obtained.

EXAMPLE 5

Example 1 is repeated except that the amount of Dayglo Saturn Yellow is increased to 0.40%. A comparable golf ball is obtained but the high level of dye makes the ball somewhat less bright and so less visible.

EXAMPLE 6

Example 1 is repeated except that the amount of Dayglo Saturn Yellow is reduced to 0.01%. A comparable golf ball is obtained except that it does not have the fullness of the color of the golf ball of Example 1.

EXAMPLE 7

Example 1 is repeated except that a fluorescent pigment is used rather than a fluorescent dye and the trademark is applied to the surface of the golf ball cover before the clear coat is applied. The fluorescent pigment is Dayglo Saturn Yellow A-17-N and is used in the amount of 2.0% by weight. The resulting golf ball has a very pleasing fluorescent appearance but without the clear cover of the golf ball of Example 1. A translucent cover is obtained.

It will be understood that the claims are intended to cover all changes and modifications of the preferred embodiment of the invention herein chosen for the purpose of illustration which do not constitute departures from the spirit and scope of the invention.

What is claimed is:

1. A golf ball comprising a core and a fluorescent cover, said cover having a fluorescent material admixed therein, said fluorescent material being selected from the group consisting of 2.0 to 6.0% by weight of the cover of fluorescent pigments and 0.04 to 0.4% by weight of the cover of fluorescent dyes, the outermost surface of said golf ball having a transparent coat on the outer surface of said fluorescent cover, said golf ball having greater appearance durability than it would otherwise have in the absence of said fluorescent material, and higher gloss than it would otherwise have without said transparent coating.

2. The golf ball of claim 1 wherein the fluorescent material is a fluorescent dye.

3. The golf ball of claim 1 wherein the fluorescent material is a fluorescent pigment.

4. The golf ball of claim 1 wherein the cover is composed of an ionomer resin.

5. The golf ball of claim 1 wherein the cover includes an ultraviolet light stabilizer.

* * * * *

UNITED STATES PATENT AND TRADEMARK OFFICE

CERTIFICATE OF CORRECTION

PATENT NO. : 4,798,386

DATED : January 17, 1989

INVENTOR(S) : Raymond A. Berard

It is certified that error appears in the above-identified patent and that said Letters Patent is hereby corrected as shown below:

Column 1, line 47, change "paraticularly" to --particularly--; and

Column 4, line 39, after "but" insert --with--.

Signed and Sealed this

Eleventh Day of July, 1989

*Attest:*

DONALD J. QUIGG

*Attesting Officer*

*Commissioner of Patents and Trademarks*